US006268827B1

(12) United States Patent
Paschen et al.

(10) Patent No.: US 6,268,827 B1
(45) Date of Patent: Jul. 31, 2001

(54) METHOD AND APPARATUS FOR CARRYING SIGNALS HAVING DIFFERENT FREQUENCIES IN A SPACE-DEPLOYED ANTENNA SYSTEM

(75) Inventors: Dean Paschen, Lafayette; Dan Becker, Broomfield; Gary Rait, Boulder, all of CO (US); Paul Burlingame, La Jolla, CA (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/430,051

(22) Filed: Oct. 29, 1999

(51) Int. Cl.[7] ..... H01Q 3/22; H01Q 3/24; H01Q 3/26

(52) U.S. Cl. ..... 342/372; 342/157; 455/282; 343/758

(58) Field of Search ..... 342/372, 157; 455/282, 289, 129; 343/758

(56) References Cited

U.S. PATENT DOCUMENTS

| | | | | |
|---|---|---|---|---|
| 3,150,374 | | 9/1964 | Sunstein et al. | 343/204 |
| 4,881,222 | | 11/1989 | Goeckler et al. | 370/70 |
| 4,901,310 | | 2/1990 | Ichiyoshi | 370/75 |
| 5,220,557 | | 6/1993 | Kelley | 370/50 |
| 5,276,920 | * | 1/1994 | Kuisma | 455/282 |
| 5,553,079 | | 9/1996 | Niki et al. | 370/110.4 |
| 5,634,191 | * | 5/1997 | Beasley | 455/14 |
| 5,657,358 | | 8/1997 | Panech et al. | 375/356 |
| 5,687,194 | | 11/1997 | Paneth et al. | 375/283 |
| 5,751,700 | | 5/1998 | Imaeda | 370/263 |
| 5,821,901 | | 10/1998 | Zagrodnick et al. | 342/368 |
| 5,987,060 | * | 11/1999 | Grenon et al. | 375/213 |

* cited by examiner

*Primary Examiner*—Theodore M. Blum
(74) *Attorney, Agent, or Firm*—Sheridan Ross, P.C.

(57) ABSTRACT

The present invention provides a method and apparatus for carrying signals having different frequencies in a space-deployed antenna system. When the antenna system is in a first mode, DC power, command information and RF signals (1) are multiplexed via a multiplexer, (2) propagate along a RF transmission line and (3) are appropriately demultiplexed by a demultiplexer associated with each T/R module. Similarly, when the antenna system is in a second mode, telemetry data and RF signals (1) are multiplexed via a multiplexer, (2) propagate along the RF transmission line and (3) are appropriately demultiplexed by a demultiplexer at a driver stage. By using the RF transmission lines associated with each T/R module to deliver (1) DC power, (2) command data and (3) RF signals in the first mode and to deliver (1) telemetry data and (2) RF signals in the second mode, the DC power and command/telemetry wire harnesses (and their respective conductors) may be eliminated. Thus, the overall weight of the antenna system may be reduced. Furthermore, deployment risks may be reduced. Finally, the overall cost of the antenna system may be reduced.

16 Claims, 5 Drawing Sheets

METHOD AND APPARATUS FOR CARRYING SIGNALS HAVING DIFFERENT FREQUENCIES IN A SPACE-DEPLOYED ANTENNA SYSTEM

FIELD OF THE INVENTION

The present invention relates to antenna systems and, more particularly, to antenna systems which are deployed in space.

BACKGROUND OF THE INVENTION

A communications satellite is an artificial satellite placed into orbit around earth to, among other things, facilitate communications on earth. Communications satellites normally include antenna systems, which typically receive information from and transmit information to various locations on earth.

Phased-array antenna systems, which are well-known, are one type of antenna system that has been used with communications satellites. A phased-array antenna system is comprised of a plurality of antenna elements which are suitably spaced relative to one another. The antenna system generates a radiation pattern having a shape and direction that is determined by the combination of the relative phases and amplitudes of the signals applied to the antenna elements. By varying the relative phases of the signals applied to the antenna elements, the antenna's direction of radiation may be steered.

Conventional phased-array antenna systems typically include a driver stage, a plurality of transmit/receive modules ("T/R modules") and an RF feed network comprised of RF transmission lines. In addition, such antenna systems include a DC power wire harness having a plurality of DC power signal conductors and a digital command/telemetry signal wire harness having a plurality of command/telemetry signal conductors.

Thus, typically, in conventional phased-array antenna systems, each T/R module is electrically connected to the driver stage via (1) an RF transmission line, (2) a DC power signal conductor from the DC power wire harness and (3) a command/telemetry signal conductor from the digital command/telemetry signal wire harness. Both the DC power signal conductors and the command/telemetry signal conductors are typically several meters (or more) in length and require shielding, sheathing, connectors and connector back shells. Furthermore, both the DC power wire harness and the digital command/telemetry signal wire harness require mounting hardware. Thus, when a phased-array antenna system includes hundreds or more TIR modules, the complexity and weight of the system increases dramatically due to the presence of the DC power wire harness, digital command/telemetry signal wire harness and their respective conductors.

When communications satellites are deployed into space, costs associated with delivering spacecraft payloads into the earth's orbit are based on the payload's weight. Thus, there is a need to reduce the weight of antenna systems associated with communications satellites. In addition, because antenna deployment is one of the highest risk components of a space-based satellite mission, there is a need to reduce antenna deployment risks. Finally, there is a need to reduce antenna costs, including costs related to procurement, testing and installation.

SUMMARY OF THE INVENTION

The present invention is designed to overcome the aforementioned problems and meet the aforementioned, and other, needs.

It is an object of the present invention to reduce the weight of antenna systems associated with communications satellites.

It is another object of the invention to reduce antenna deployment risks.

It is yet another object of the invention to reduce antenna costs, including costs related to procurement, testing and installation.

In accordance with the objects of the invention, the present invention advantageously reduces the number of electrical connections made to each T/R module. More specifically, the present invention eliminates both the DC power wire harness and the digital command/telemetry wire harness (and their respective conductors), while still providing their associated signals from the driver stage to each T/R module. Even more specifically, when the antenna is in a first mode, DC power, command information and RF signals (1) are multiplexed via a multiplexer, (2) propagate along the RF transmission line and (3) are appropriately demultiplexed by a demultiplexer associated with each T/R module. Similarly, when the antenna is in a second mode, telemetry or operations-related data (including, e.g., status information) and RF signals (1) are multiplexed via a multiplexer, (2) propagate along the RF transmission line and (3) are appropriately demultiplexed by a demultiplexer at the driver stage.

By using the RF transmission lines associated with each T/R module to deliver (1) DC power, (2) command data and (3) RF signals in a first mode and to deliver (1) telemetry data and (2) RF signals in a second mode, the DC power and command/telemetry wire harnesses (and their respective conductors) may be eliminated. Thus, the overall weight of the antenna system may be reduced. Furthermore, deployment risks may be reduced since, in conventional systems, both the DC power wire harness and command/telemetry wire harness (and their respective conductors) may inhibit deployment mechanisms. Finally, the overall cost of the antenna system may be reduced since the components required to implement the multiplexer/demultiplexer circuits can be realized in inexpensive, silicon integrated circuits (or alternatively in discrete form) placed in each T/R module and in the driver stage. In contrast, there is relatively greater expense in procuring, testing and installing conventional wire harnesses and connecting them from the driver stage to each T/R module via DC power signal conductors and command/telemetry signal conductors.

Other objects, features and advantages of the invention will be apparent from the following specification taken in conjunction with the following drawings.

DETAILED DESCRIPTION OF THE PREFERRED EMBODIMENT

Figure 1:
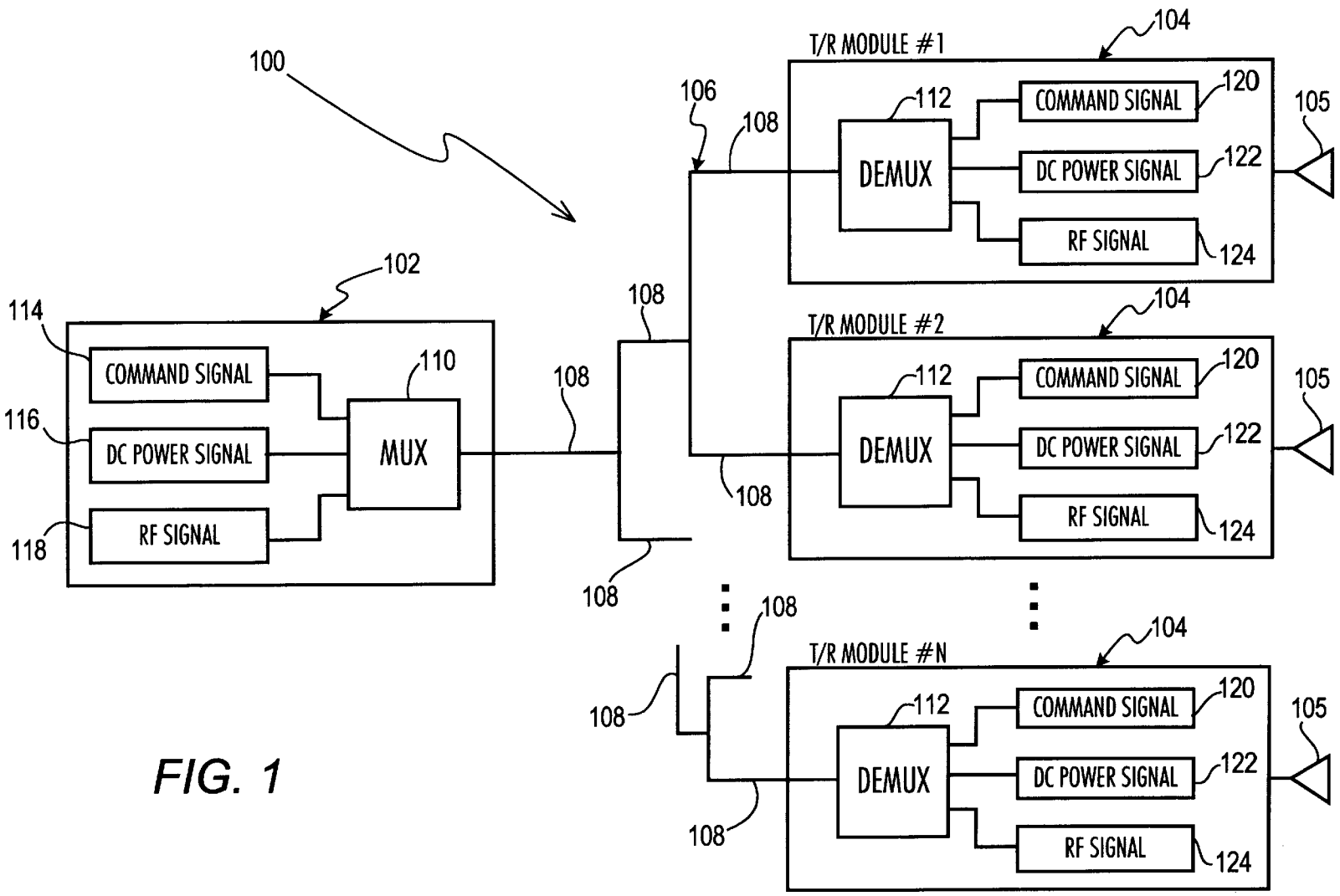
FIG. 1 is a simplified block diagram of an embodiment of the present invention, wherein command data, DC power and RF signals are being provided from the driver stage to the T/R modules without a DC power wire harness nor a command/telemetry wire harness (or their respective conductors)

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspects of the invention to the embodiments illustrated.

FIG. 1 is a simplified block diagram of an embodiment of the phased-array antenna system 100 of the present invention, wherein control or command signals, DC power and RF signals, carrying data or other information, are to be provided from a driver stage 102 to each T/R module 104. The antenna system 100 includes a driver stage 102, T/R modules 104, antenna elements 105 and an RF feed network 106. The RF feed network 106 includes RF transmission lines 108. Each of these lines 108 includes a single, preferably, center conductor that is used to carry all of the control/command, DC power and RF signals between the driver stage 102 and the T/R modules 104. As will be understood by those skilled in the art, the antenna system 100 shown in FIG. 1 is an active array, in that it includes separate T/R modules 104 for each antenna element 105.

In contrast to typical phased-array antenna systems, the antenna system 100 shown in FIG. 1 does not include a DC power wire harness or a digital command/telemetry signal wire harness (or their respective conductors). Instead, the phased-array antenna system 100 includes a multiplexer 110 (to be explained in further detail in connection with FIG. 2) preferably located proximate (or "within") the driver stage 102 and a plurality of demultiplexers 112 (to be explained in further detail in connection with FIG. 3) preferably located proximate (or "within") each T/R module 104.

When the antenna 100 is in transmit mode, the multiplexer 110 combines command signal 114, DC power signal 116 and RF signal 118 and transmits the combination of such signals across the RF feed network 106 via the RF transmission lines 108. The combined signal is received at each T/R module 104 and is demultiplexed via the demultiplexer 112 associated with each T/R module 104 to obtain command signal 120, DC power signal 122 and RF signal 124 at each T/R module 104. Accordingly, the DC power wire harness and the digital command/telemetry signal wire harness (and their respective conductors), which are found in typical phased-array antenna systems, may be eliminated. As will be understood by those skilled in the art, a similar scheme may be used when telemetry signals and RF signals are to be transmitted from one or more T/R modules 104 to the driver stage 102 (as will be discussed in connection with FIG. 4).

Figure 2:
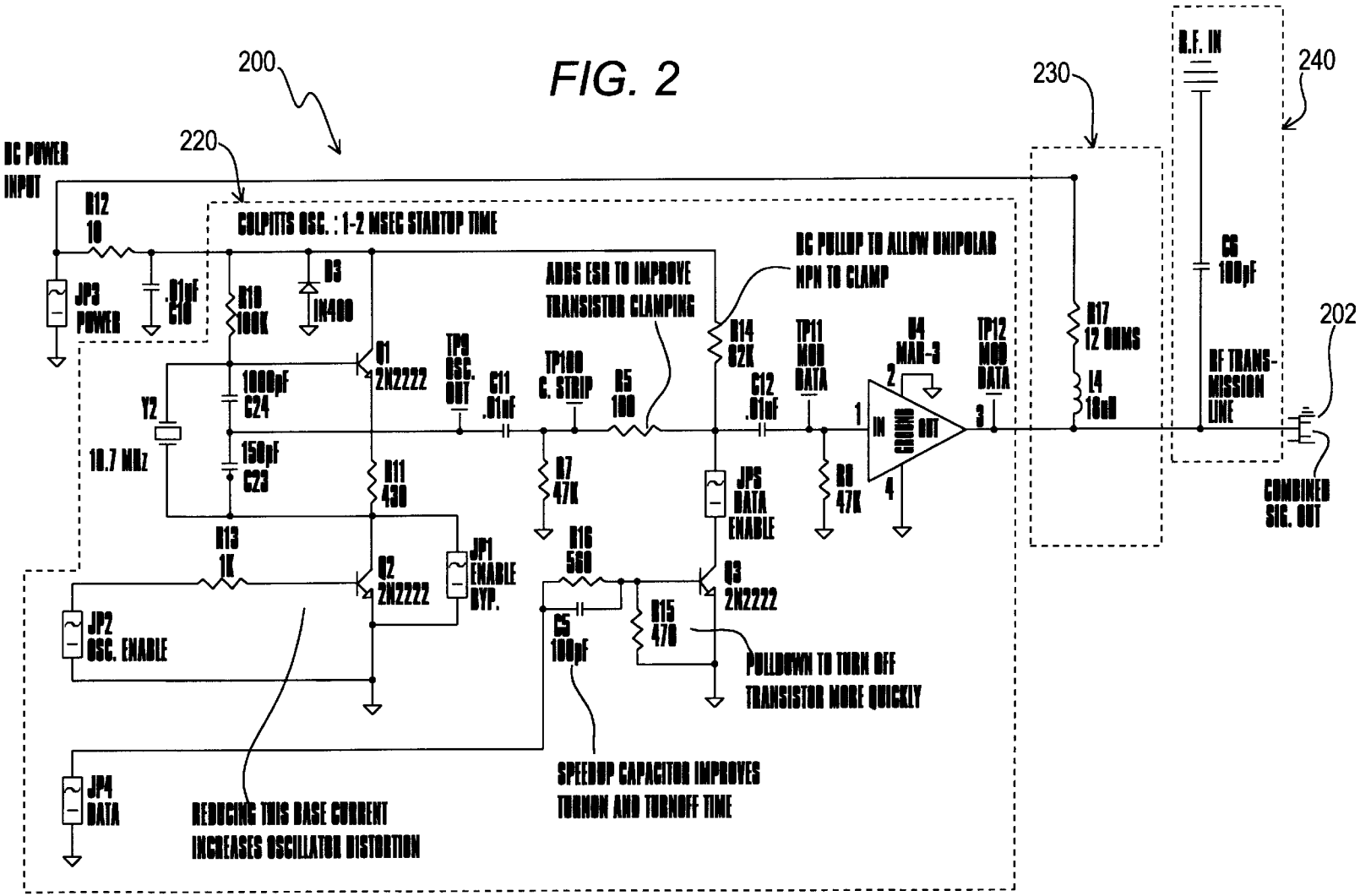
FIG. 2 is a circuit diagram of the multiplexer shown in FIG. 1 for an embodiment of the present invention.

FIG. 2 is a circuit diagram of the multiplexer 110 of the antenna system 100 shown in FIG. 1. The preferred values of the components of the circuit 200 of FIG. 2 are indicated thereon; however, as will be understood by those skilled in the art, such values may be varied and equivalent components may be substituted therefor.

As mentioned above, the purpose of the multiplexer 110 (and, hence, the circuit 200) is to combine command signal 114, DC power signal 116 and RF transmission signal 118. The combined signal is to be provided to pin 202 (Combined Sig. Out) shown in FIG. 2. In an effort to simplify the discussion of the circuit 200, it will generally be discussed in sections.

Command Section

The command section is indicated by the components surrounded by the dashed lines identified by reference numeral 220. The ultimate goal of the command section 220 is to provide an amplified, modulated control or command signal out of amplifier U4.

The combination of transistor Q1, resistor R10, diode D3, crystal oscillator Y2, capacitor C23, capacitor C24 and resistor R11 forms a Collpitts oscillator which oscillates at the crystal frequency of 10.7 MHz (although many other values are possible). A modulator which includes the aforementioned oscillator and an on-off keying circuit (comprised of resistor R16, resistor R15, capacitor C5 and transistor Q3) is provided. Because the oscillator takes a relatively long period to start up (approximately 1–2 milliseconds), the above-mentioned on-off keying circuit is provided, which improves the modulator's turn-on and turn-off times. Those skilled in the art will understand that other modulation formats may be substituted for the on-off keying (OOK) modulation described above.

Command data (i.e., the modulating signal), in the form of digital TTL level data, is provided to JP4 via a microprocessor (not shown) or other conventional means. The command data is the modulating signal that is used to provide command signals which are supplied to T/R modules 104. Thus, when the command signal is a "digital zero," the collector of transistor Q3 does not conduct to ground and allows the oscillator's signal to be provided to amplifier U4. Similarly, when the command signal is a "digital one," the collector of transistor Q3 grounds the oscillator's output to prevent the oscillator's signal from being provided to the amplifier U4. Accordingly, the command data signal is used as the modulating signal for the oscillator.

In case the oscillator is to be turned off (for example, to save power), rather than its output merely being shorted to ground, an oscillator enable/disable circuit is provided. Specifically, the oscillator enable/disable circuit includes transistor Q2, resistor R13, JP2 and JP1.

By way of the oscillator and the on-off keying circuit (which is controlled via the command data signal), modulated control data is provided to amplifier U4. The main function of the amplifier is to amplify the modulated control data to improve signal to noise performance and ultimately generate an amplified, modulated command signal at its output.

DC Power Diplexer Section

The DC power diplexer section 230, which is a combination of resistor R17 and inductor L4, operates as a signal combiner. Thus, the DC power diplexer section is used to couple DC power from JP3 with the amplified modulation signal.

RF Signal Combiner Section

The RF signal combiner section 240 includes capacitor C6, which operates as a DC blocker. (Alternative embodiments may include more elements in a $\pi$or T configuration, for example.) Thus, the RF signal from RF In is coupled to the amplified modulation signal and the DC power signal. Accordingly, the combination of all three signals are then provided at pin 202 (Combined Sig. Out).

Figure 3:
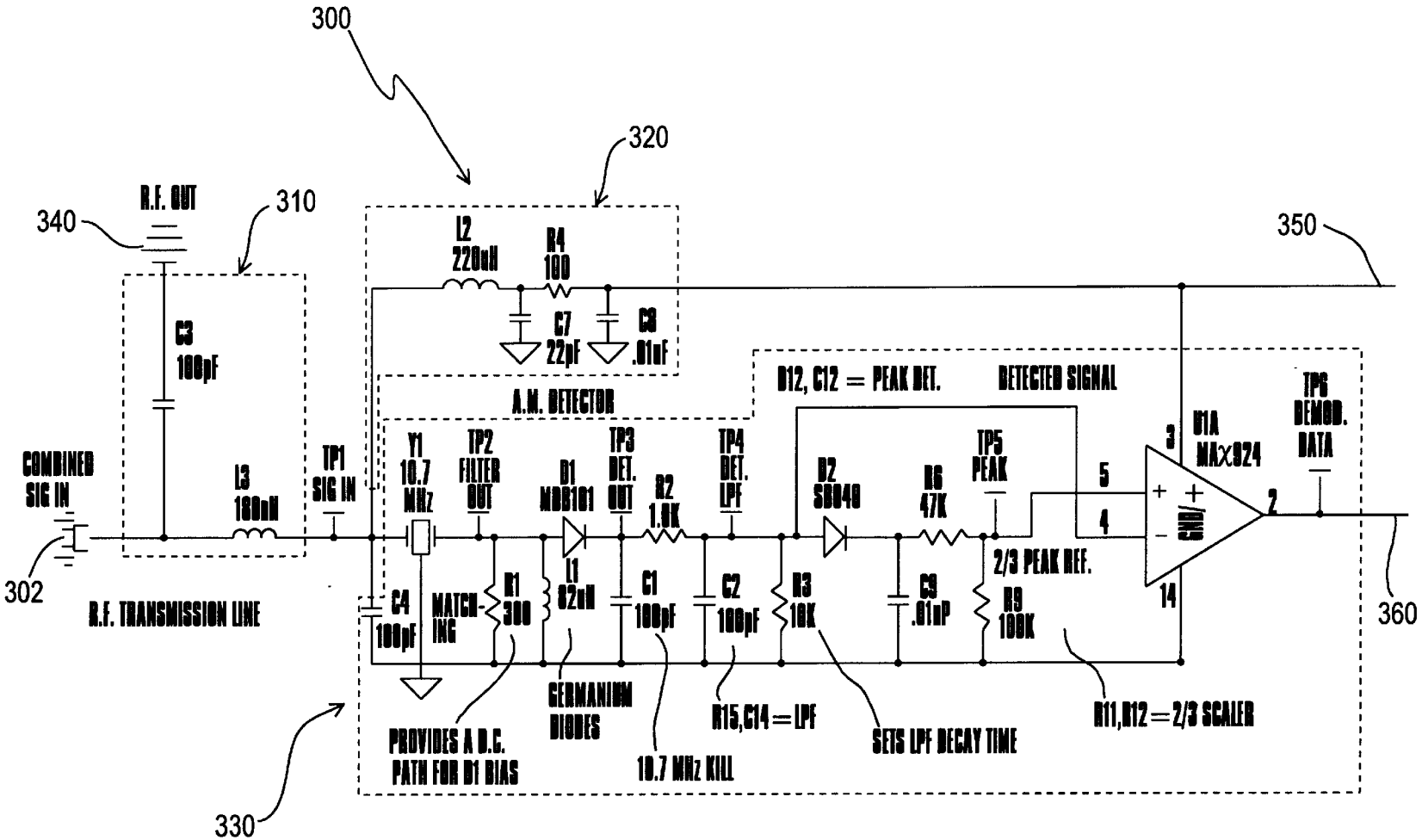
FIG. 3 is a circuit diagram of the demultiplexer shown in FIG. 1 for an embodiment of the present invention.

FIG. 3 is a circuit diagram of the demultiplexer 112 of the antenna system 100 shown in FIG. 1. The preferred values of the components of the circuit 300 of FIG. 3 are indicated thereon; however, as will be understood by those skilled in the art, such values may be varied and equivalent components may be substituted therefor.

As mentioned above, the purpose of the demultiplexer 112 (and, hence, the circuit 300) is to receive (via the RF feed network 106) the combined signal output from the multiplexer 110 and to separate the command signal 120, DC power signal 122 and RF signal 124 from the combined signal. With reference to FIG. 3, the combined signal is received at pin 302 (Combined Sig. In). In an effort to simply the discussion of the circuit 300, it will generally be discussed in sections.

RF Signal Section

The RF signal section 310 is used to separate the RF signal from the combined signal in. Capacitor C3 operates as a DC blocker so that the DC power signal can only be conducted through inductor L3. Similarly, inductor L3 blocks the RF signal from the DC power diplexer section 320 and command signal section 330. This serves to minimize parasitic loading of the RF signal at pin 302. Accordingly, inductor L3 permits the amplified modulated signal (having a frequency of about 10.7 MHz) and the DC signal to pass.

DC Power Diplexer Section

The DC power diplexer section 320 is used to separate the DC power signal from the amplified modulated signal. The DC power diplexer section includes the combination of inductor L2 and resistor R4. Furthermore, capacitor C7 and capacitor C8 are used to remove residual AC components from the DC power signal.

Command Signal Section

The command signal section 330 is used to recover the command signal. The signal remaining after the RF and DC power signals have been split off is provided to ceramic filter Y1 to obtain an adequate signal-to-noise ratio. An envelope detector, formed by the combination of resistor R1, inductor L1, diode D1 and capacitor C1, is used to detect the envelope of the modulated signal in order to recreate the digital data signal. Further, R2 and C2 form a low-pass filter which is used to remove residual high-frequency components from the envelope. Finally, the remaining signal is provided to an adaptive comparator circuit formed by the combination of diode D2, capacitor C9, resistor R6 and resistor R9. Diode D2 and capacitor C9 are charged up to the peak of the envelope, while resistor R2 and resistor R9 are set to produce an output on pin 5 which is ⅔ of the peak, which operates as a reference for the comparator U1A. The other input to the comparator U1A is the detected signal on pin 4. Thus, the detected signal on pin 4 is compared to an adaptive reference. Accordingly, even when signal levels are low, an accurate determination may be made for detection of a peak. The output of the comparator, on pin 4, is the command signal. Thus, the RF signal, DC power signal and the command signal are all separated as identified by reference numerals 340, 350 and 360, respectively.

Figure 4:
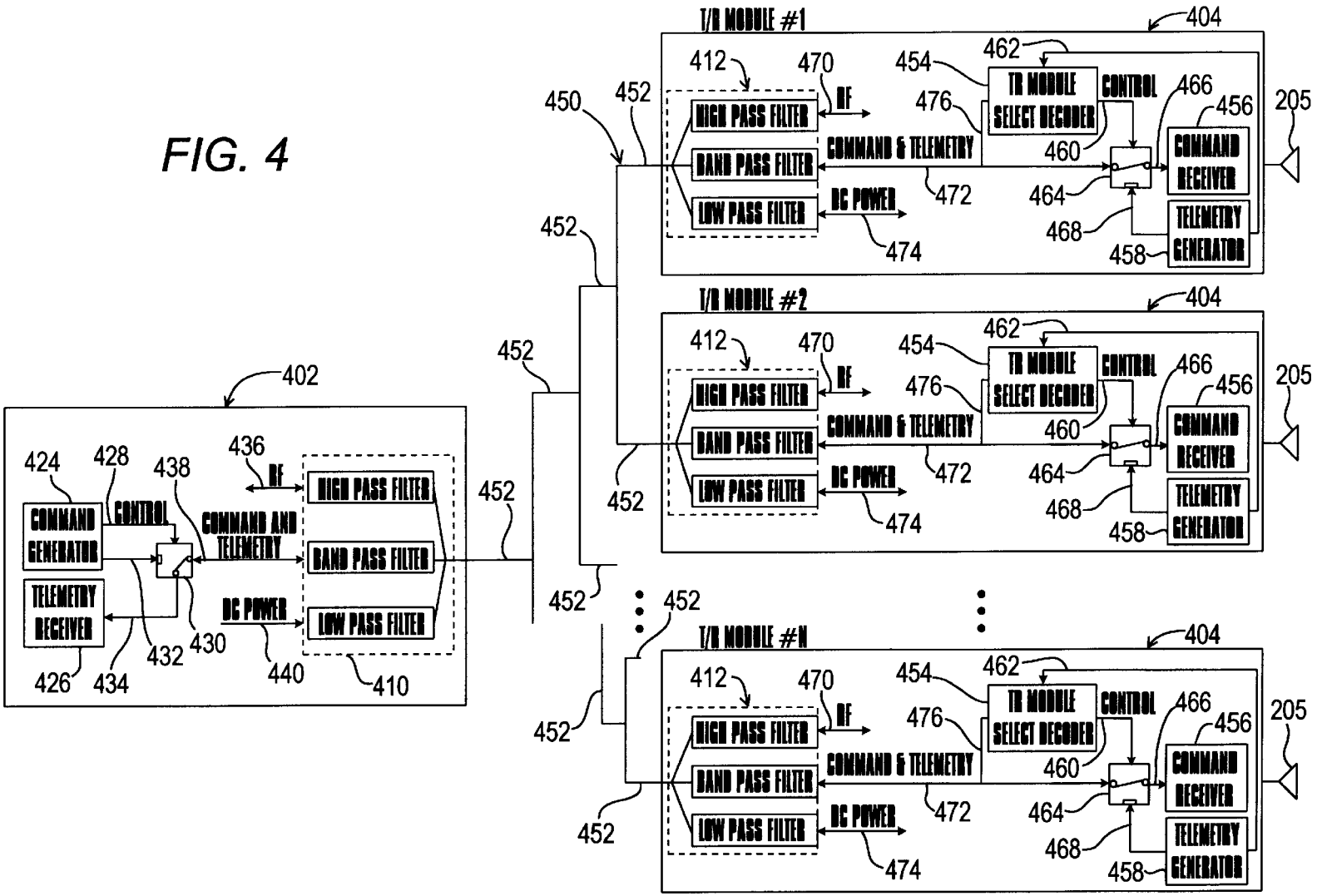
FIG. 4 is a block diagram of an embodiment of the present invention generally showing two modes in which the antenna system may operate.

FIG. 4 is a detailed block diagram of another embodiment, identified by reference numeral 400, of the antenna system of the present invention. While FIG. 1 showed how command, DC power and RF signals could be combined and transmitted from the driver stage 102 to the T/R modules 104 (and then be separated), FIG. 4 shows (in addition to what is shown in FIG. 1) how telemetry and RF signals can be combined and transmitted from the T/R modules 404 to the driver stage 402.

Thus, in a first mode, the antenna system 400 operates to combine (1) command, (2) DC power and (3) RF signals into a combined signal from the driver stage 402 to the T/R modules 404, which combined signal is then separated into command, DC power and RF signals by the T/R modules 404. Similarly, in a second mode, the antenna system 400 operates to combine (1) telemetry and (2) RF signals into a combined signal from a T/R module 404, which combined signal is then separated into telemetry and RF signals at the driver stage 402. As will be understood in the art, in order for both modes to be operable, both a multiplexer and demultiplexer are provided at each T/R module 404 and at the driver stage 402. For convenience, however, (and to more clearly describe the invention) the multiplexer/ demultiplexer combination for the driver stage 402 is depicted as diplexer 410. Likewise, the multiplexer/demultiplexer combination for each T/R module 404 is depicted as diplexer 412.

As will also be understood by those skilled in the art, neither the multiplexer at each T/R module 404 nor the demultiplexer at the driver stage 402 includes a DC power diplexer (refer to FIGS. 2 and 3), since the DC power signal need only supplied from the driver stage 402 to each T/R module 404. Accordingly, DC power is supplied to all of the active elements via its transmission from the driver stage 402 to each T/R module 404 in a manner that will be understood by those skilled in the art.

Referring again to FIG. 4, certain components (shown in block diagram form) will now be described to show how the antenna system 400 operates in both modes. Specifically, driver stage 402 includes a command generator 424, a telemetry receiver 426, a control line 428, a switch 430, a command signal conductor 432, a telemetry signal conductor 434, an RF signal conductor 436, a combined command/ telemetry conductor 438, a DC power conductor 440 and the aforementioned diplexer 410.

When command, DC power and RF signals are to be delivered to the T/R modules 404, the command generator 424 generates a control signal on control line 428 which causes switch 430 (which, in a preferred embodiment, is in a default position that electrically connects the telemetry receiver 426 to the combined command/telemetry conductor 438 via telemetry signal conductor 434) to connect the command generator 424 to the combined command/ telemetry conductor 438. Thus, the command signal is provided to the diplexer 410, where it is combined with the DC power and RF signals. The combined signal is then delivered across the RF feed network 450 via RF transmission lines 452 to all of the T/R modules 404.

The T/R modules 404 include the aforementioned diplexer 412, a T/R module select decoder 454, a command receiver 456, a telemetry generator 458, a first control line 460, a second control line 462, a switch 464, a command signal conductor 466, a telemetry signal conductor 468, an RF signal conductor 470, a combined command/telemetry conductor 472 and a DC power conductor 474. The demultiplexer 412 receives the combined signal and separates it into an RF signal, a command/telemetry signal and a DC power signal. The command signal is coupled to T/R module select decoder 454 via the combined command/telemetry conductor 472 and T/R module select decoder conductor 476. The T/R module select decoder 454 determines whether the command data included in the command signal is intended for a particular T/R module 404, since each T/R module 404 includes a unique electronic serial number or the like. More specifically, the T/R module select decoder 454 reads header information contained within the command signal (which includes, for example, an electronic serial number of a T/R module 404) to determine whether it is the intended recipient of the command data being broadcast via the RF feed network 450 by comparing the header information to its electronic serial number. As will be understood by those skilled in the art, the specific protocol may also include a method of delivering global commands or commands to a group of T/R modules.

If the T/R module select decoder 454 determines that the command data is intended for its particular T/R module 404, the T/R module select decoder 454 generates a control signal on first control line 460, which causes switch 464 to couple command receiver 456 with combined command/telemetry conductor 472 via command signal conductor 466. The command receiver 456 receives the command data, interprets it and performs a function in response thereto (such as varying the phase of the RF signal delivered to antenna element 205, in order to steer the beam of the antenna 400), as will be understood by those skilled in the art.

One of the functions that may be performed, based upon command data being provided to the command receiver 456, is that telemetry information may be generated and provided from a particular T/R module 404 to the driver stage 402. Such telemetry information may include, for example, the sensed temperature at a particular T/R module, internal voltages or currents, or many other operations-related (or non-operations related) parameters.

Thus, when a particular T/R module 404 is to be queried for specific telemetry information, command data is provided to such T/R module 404 as set forth above (wherein the command data specifies the particular telemetry information that is to be provided from the T/R module 404 to the driver stage 402). In response, the telemetry generator 458 generates a first control signal on second control line 462 which is received by T/R module select decoder 454. A second control signal is generated on first control line 460, which causes the switch 464 to couple the telemetry generator conductor 468 to the combined command/telemetry conductor 472 so that telemetry data may be forwarded to diplexer 412 and be combined with RF signal. The combined received signal is then fed to driver stage 402 via RF feed network 450.

The combined signal is received by the diplexer 410 which separates the combined signal into a telemetry signal and an RF signal. The telemetry signal is coupled to the telemetry receiver 426 via combined command/telemetry conductor 438, switch 430 and telemetry receiver conductor 434. To identify the particular T/R module 404 from which the telemetry information is being provided, the telemetry signal includes a header associated with the T/R module 404 (e.g., its electronic serial number or the like).

Figure 5:
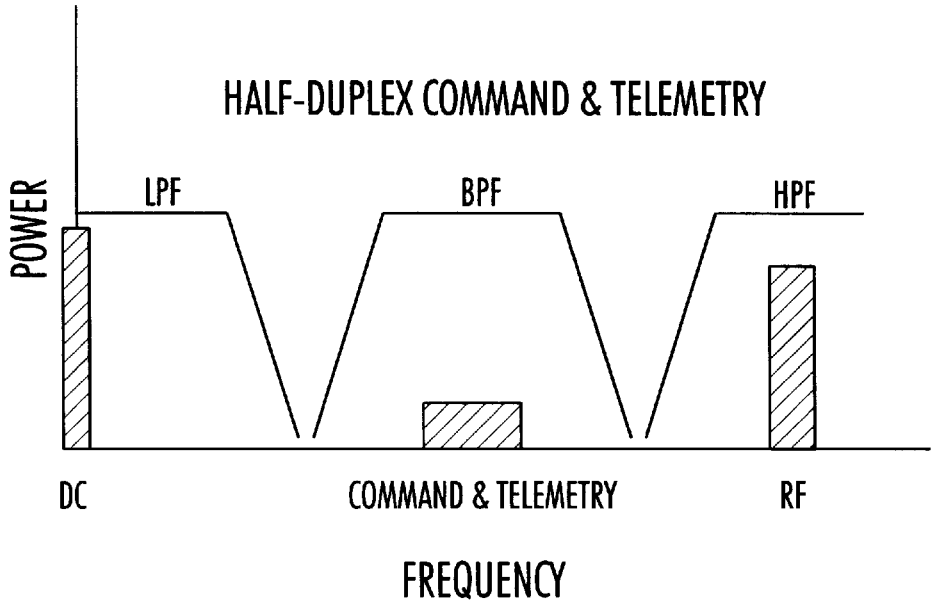
FIG. 5 is a frequency plot showing the relative frequencies of the DC power signal, command signal, telemetry signal and RF signal for an embodiment of the present invention in a half-duplex configuration; and, FIG. 6 is a frequency plot showing the relative frequencies of the DC power signal, command signal, telemetry signal and RF signal for an embodiment of the present invention in a full-duplex configuration.

FIG. 5 is a frequency plot showing the relative frequencies of the DC power signal, command/telemetry signal and RF signal for the antenna system of the present invention in a half-duplex configuration. As will be understood by those skilled in the art, a half duplex configuration permits either command data or telemetry data (but not both at the same time) to be transmitted between the driver stage 402 and T/R modules 404 (e.g., a walkie-talkie). Accordingly, in the half duplex configuration, the command data and telemetry data are intended to be modulated at the same frequency. As shown in FIG. 5, the RF signal has a relatively high frequency defined by high-pass filter HPF, the DC signal has a relatively low frequency defined by low-pass filter LPF and the command/telemetry signals have a carrier frequency which is in an intermediate frequency range defined by bandpass filter BPF.

Figure 6:
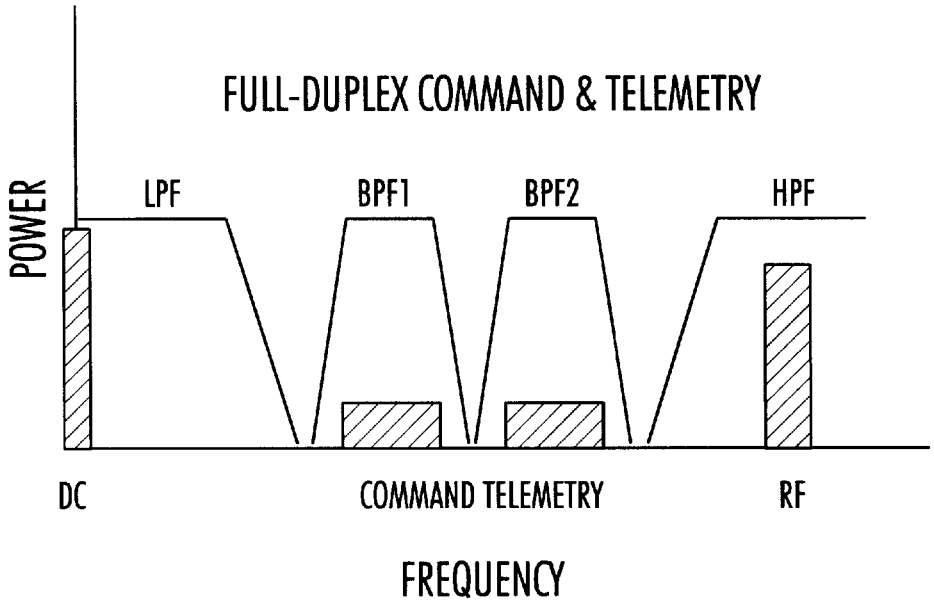

FIG. 6 is a frequency plot showing the relative frequencies of the DC power signal, command signal, telemetry signal and RF signal for the antenna system of the present invention in a full-duplex configuration. As will be understood by those skilled in the art, a full-duplex configuration permits command data and telemetry data to be transmitted between the driver stage 402 and the T/R modules 404 at the same time (e.g., a conventional wireline telephone). Accordingly, in the full-duplex configuration, the command data and telemetry data are intended to be modulated at different carrier frequencies. As shown in FIG. 6, the RF signal has a relatively high frequency defined by high-pass filter HPF, the DC signal has a relatively low frequency defined by low-pass filter LPF, the command signal has a first intermediate frequency defined by first bandpass filter BPF1 and the telemetry signal has a second intermediate frequency defined by second bandpass filter BPF2.

As will be understood by those skilled in the art, instead of using a single driver stage as shown in the drawings, multiple driver stages may be provided. Furthermore, as will also be understood by those skilled in the art, elimination of solely the DC power wire harness would be beneficial since the DC power wire harness (and its associated conductors) are generally quite heavy and costly in order to minimize power losses. Accordingly, the principles of the present invention may be used to eliminate solely the DC power wire harness, instead of both, wire harnesses. Finally, it should be noted that the advantages of the present invention may be useful for phased-array antenna systems that are not deployed in space and; therefore, scope of the present invention should not be limited to the particular embodiments described herein.

It will be understood that the invention may be embodied in other specific forms without departing from the spirit or central characteristics thereof. For example, instead of providing power to the T/R modules via a DC signal, a low frequency AC signal (e.g., between 0–1000 Hz) may be used. Furthermore, it should be understood that telemetry information may be provided from the driver stage to one or more T/R modules. Even further, telemetry information may be generated automatically (after some predetermined time interval), instead of in response to a command signal from the driver stage. Finally, switch 464, command receiver 456, decoder 454, telemetry generator 458 and line 466 could all exist in a single microcontroller, since they are simply functional entities and may be embodied in a variety of ways.

The present examples and embodiments, therefore, are to be considered in all respects as illustrative and not restrictive, and the invention is not intended to be limited to the details given herein.

What is claimed is:

1. A method for carrying a number of different signals in an antenna system having a number of components including antenna elements, comprising:

providing each of a power signal, a data signal and a command signal;

carrying each of said power signal, said data signal and said command signal using a common conductor, wherein said command signal is addressed to a selected one of said antenna elements of said antenna system;

separating each of said power signal, said data signal and said command signal;

applying at least said power signal to a plurality of the components of the antenna system; and receiving said command signal by at least a one of said components associated with said selected one of said antenna elements and applying said command signal to said selected one of said antenna elements of said antenna system.

2. A method, as claimed in claim 1, wherein:

said command signal includes a modulated command signal having a frequency different from frequencies of each of said power signal and said data signal.

3. A method, as claimed in claim 1, wherein:

said providing step includes preventing substantially using filter circuitry said command signal from passing along a power conducting line carrying said power signal.

4. A method, as claimed in claim 3, wherein:

said providing step includes preventing substantially said command signal and said power signal from being conducted along a data conducting line that carries said data signal.

5. A method, as claimed in claim 1, wherein:

said carrying step includes using a center conducting line of said common conductor to transmit each of said power signal, said data signal and said command signal.

6. A method, as claimed in claim 1, wherein:

said providing step includes providing an operations-related signal that includes information related to at least one component of the antenna system and in which said operations-related signal is carried using said common conductor in a direction opposite that of said command signal.

7. A method, as claimed in claim 1, wherein:

said providing step includes receiving said command signal by modulating circuitry and using said power signal to power at least one component of said modulating circuitry.

8. A method, as claimed in claim 1, wherein:

said applying step includes applying said power signal to a number of transmit/receive modules, amplifiers and phase shifters of the antenna system.

9. An apparatus for using different signals including supplying power to components of an antenna system, comprising:

combining circuitry that joins together each of a power signal, a data signal and a command signal;

a common conductor for carrying each of said power signal, said data signal and said command signal;

separating circuitry electrically connected to said common conductor that separates said power signal, said data signal and said command signal; and antenna system circuitry electrically connected to said separating circuitry that receives at least said power signal and said command signal in which a number of components of the antenna system circuitry are supplied power by said power signal and in which operation of an antenna element associated with said antenna system circuitry is controlled by said command signal, wherein said command signal controls a phase of said data signal in order to steer a beam of said antenna element.

10. An apparatus, as claimed in claim 9, wherein:

said common conductor includes a center conducting line that can simultaneously transmit each of said power signal, said data signal and said command signal.

11. An apparatus, as claimed in claim 9, wherein:

said combining circuitry includes a first circuit assembly for joining said power signal with said command signal and for joining said power signal and said command signal with said data signal.

12. An apparatus, as claimed in claim 9, wherein:

said command signal includes a modulated command signal and said combining circuitry includes a second circuit assembly for generating said modulated command signal using said command signal that is input thereto.

13. An apparatus, as claimed in claim 9, wherein:

said power signal is carried by a power signal conducting line and said combining circuitry includes filter circuitry for preventing said command signal and said data signal from passing to said power signal conducting line.

14. An apparatus, as claimed in claim 12, wherein:

said data signal has a first frequency and said modulated command signal has a second frequency, with each of said first and second frequencies being different from each other.

15. An apparatus, as claimed in claim 14, wherein:

a modulated operations-related signal is transmitted using said common conductor in a direction opposite that of said command signal and in which said modulated operations-related signal has a third frequency different from each of said first and second frequencies.

16. An apparatus for using different signals including supplying power to components of an antenna system, comprising:

combining circuitry that joins together each of a power signal, a data signal and a command signal;

a common conductor for carrying each of said power signal, said data signal and said command signal;

separating circuitry electrically connected to said common conductor that separates said power signal, said data signal and said command signal;

antenna system circuitry electrically connected to said separating circuitry that receives at least said power signal and said command signal in which a number of components of the antenna system circuitry are supplied power by said power signal and in which operation of an antenna element associated with said antenna system circuitry is controlled by said command signal; and modulating circuitry for modulating an operations-related signal that is provided using at least one component of said antenna system circuitry, said operations-related signal having a frequency different from each of said power signal, said data signal and said command signal and with said operations-related signal being carried by said common conductor in an opposite direction from that of said command signal, and said operations-related signal being indicative of status information associated with said one component.

* * * * *